US005145080A

United States Patent [19]

Imbery, Jr.

[11] Patent Number: 5,145,080

[45] Date of Patent: Sep. 8, 1992

[54] POSITIVE ORIENTATION SYSTEM FOR A THREADED CLOSURE AND CONTAINER

[75] Inventor: Leo R. Imbery, Jr., Crystal Lake, Ill.

[73] Assignee: Seaquist Closures, Mukwonago, Wis.

[21] Appl. No.: 692,203

[22] Filed: Apr. 26, 1991

[51] Int. Cl.[5] ..... B65D 41/04

[52] U.S. Cl. ..... 215/331; 215/329; 215/330; 215/216; 215/221

[58] Field of Search ..... 215/331, 329, 221, 330, 215/216, 222; 220/301, 290

[56] References Cited

U.S. PATENT DOCUMENTS

| | | | |
|---|---|---|---|
| 3,110,410 | 11/1963 | Pehr . | |
| 3,339,773 | 5/1966 | Stull . | |
| 3,831,797 | 8/1974 | Stevens, Jr. | 215/329 X |
| 3,951,289 | 4/1976 | Lenden . | |
| 4,036,385 | 7/1977 | Morris | 215/221 X |
| 4,098,419 | 7/1978 | Virog, Jr. et al. . | |
| 4,127,221 | 11/1978 | Vere . | |
| 4,134,513 | 1/1979 | Mumford . | |
| 4,273,248 | 6/1981 | Lehmann | 215/331 |
| 4,280,632 | 7/1981 | Yuhara . | |
| 4,310,101 | 1/1982 | Sekine | 215/331 X |
| 4,365,721 | 12/1982 | Montgomery . | |
| 4,454,965 | 6/1984 | Kirk, Jr. . | |
| 4,456,136 | 6/1984 | Palsson . | |
| 4,763,801 | 8/1988 | Nycz . | |
| 4,799,597 | 1/1989 | Mayes et al. . | |
| 4,913,299 | 4/1990 | Petro | 215/216 X |
| 4,940,168 | 7/1990 | Shadwell et al. . | |
| 4,991,733 | 2/1991 | Marino | 215/216 X |

FOREIGN PATENT DOCUMENTS 0011575 5/1980 European Pat. Off. ..... 215/331

OTHER PUBLICATIONS

Affidavit of Bruce M. Mueller.

*Primary Examiner*—Stephen Marcus
*Assistant Examiner*—Paul A. Schwarz
*Attorney, Agent, or Firm*—Dressler, Goldsmith, Shore, Sutker & Milnamow, Ltd.

[57] ABSTRACT

A package is provided in the form of a container and closure assembly which incorporates a system for providing a positive orientation of the container closure so as to align external features of the closure and container. The container has a neck defining an opening to the container interior, an external screw thread, and a protuberance. The protuberance has generally oppositely facing abutment surfaces and at least one cam surface extending between the abutment surfaces. The closure has a skirt defining an internal screw thread for engaging the container external screw thread. The skirt defines a recess for receiving a protuberance. The recess is defined at opposite ends by spaced-apart engaging surfaces for confronting the protuberance abutment surfaces. The skirt is sufficiently resilient to deform as relative threading engagement is effected between the closure and the container neck to accommodate relative movement of the container neck and closure until the protuberance is received in the recess to prevent relative rotation between the closure and container.

16 Claims, 2 Drawing Sheets

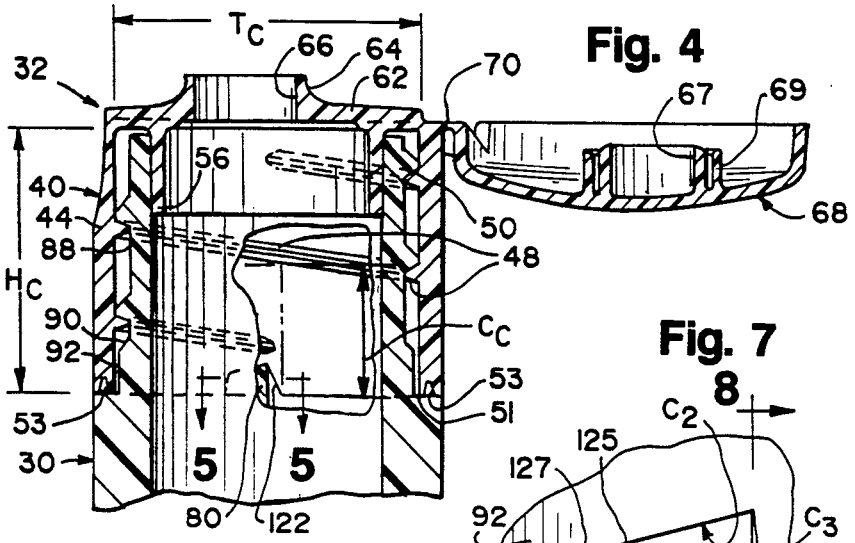
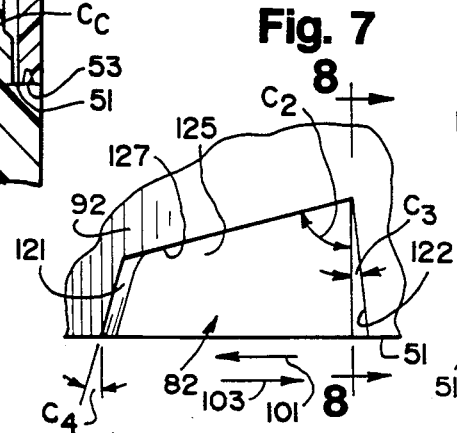
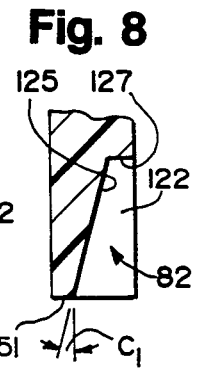
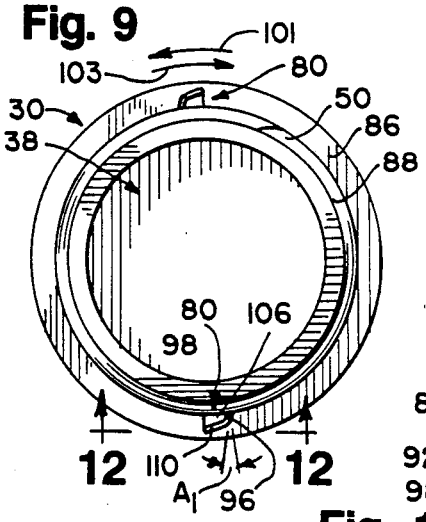
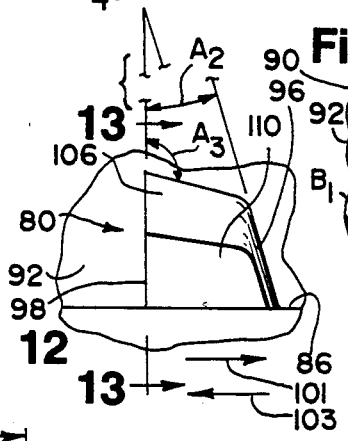
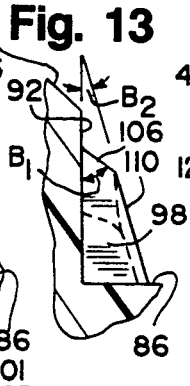
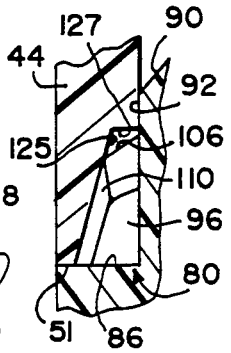
Fig. 12
Fig. 14
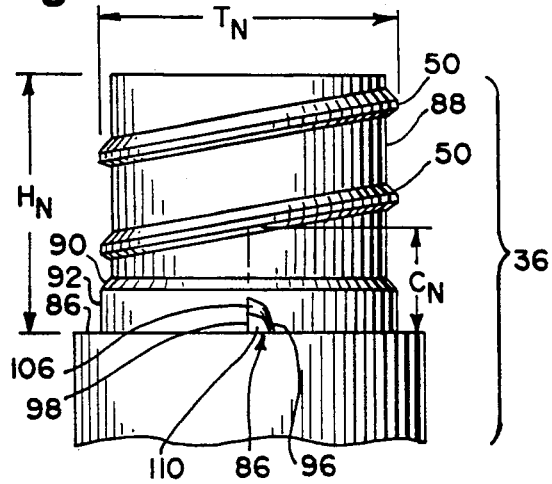
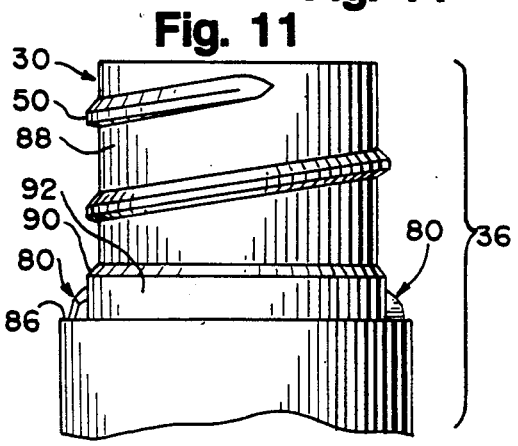

POSITIVE ORIENTATION SYSTEM FOR A THREADED CLOSURE AND CONTAINER

TECHNICAL FIELD

This invention relates to a package in the form of an assembly of a container and closure therefor. More particularly, the present invention relates to containers and closures which can be assembled by means of screw threads.

BACKGROUND OF THE INVENTION AND TECHNICAL PROBLEMS POSED BY THE PRIOR ART

A common type of container has a threaded neck and is adapted to receive a threaded closure in the form of a lid, cap, or the like. Typically, the final position of the closure on the container is not particularly critical so long as the threads on the container and closure have mated sufficiently to provide a reasonably tight engagement.

In many applications, a closure is initially applied to a container by automatic closure applying apparatus, such as a high speed capping machine. Such a machine typically incorporates a clutch mechanism that terminates the closure application process upon sensing a predetermined torque corresponding to the desired degree of threaded engagement. However, this system is not particularly precise, and the final angular or azimuthal position of the closure may vary within about a 45° arc on the circumference of the container neck. In some applications, the variation in the angular orientation of the closure on the container neck is acceptable. However, in other applications, there may be a need to more precisely position the closure on the container neck. For example, more precision may be desired if the closure has an external feature that is intended to be maintained in some predetermined relationship with a cooperating external feature on the container.

For example, it may be desireable to align a tamper-evident feature on the closure with a cooperating feature on the container neck. Also, it might be desireable to align a dispensing orifice on the closure relative to a selected portion or side of the container. It may also be advantageous to align a closure having preprinted text or graphics in a particular orientation relative to the container.

It would be desireable if an orientation system could be provided for aligning a closure and a container with respect to external features. It would be advantageous if such a system could be adapted for use with a container having an otherwise conventional configuration or finish.

In some applications, there is a need to provide a removal-resistant or tamper-resistant assembly, as well as an assembly that would provide evidence of tampering. Accordingly, it would be desireable to provide an improved orientation system of the above-discussed type that could also function to prevent removal of the closure or otherwise furnish evidence that such an attempt has been made.

The present invention provides an improved container and closure assembly which can accommodate designs having the above-discussed benefits and features.

SUMMARY OF THE INVENTION

A package is provided in the form of a container and closure assembly which incorporates a system for providing a positive orientation of the container and closure so as to align external features. The unique system inhibits removal of the closure and can serve as a means for providing evidence of tampering.

The container has a neck that defines an opening to the container interior and that defines an external screw thread. The closure has a skirt defining an internal screw thread for engaging the external screw thread on the container neck.

A protuberance is provided on either the container neck or closure skirt. In the preferred embodiment, the protuberance is provided on the container neck and has two generally oppositely facing abutment surfaces. One abutment surface faces generally in one direction of rotation, and the other abutment surface faces generally in the other direction of rotation. In the preferred embodiment, at least one cam surface extends between the abutment surfaces.

In the preferred embodiment, the recess is defined in the closure skirt by two spaced-apart engaging surfaces which are each adapted to engage a different one of the two abutment surfaces.

Either the container neck or closure skirt, or both, are sufficiently resilient to deform as relative threading engagement is effected between the closure and container neck so as to accommodate the relative movement of the protuberance and skirt until the protuberance is received in the recess. This provides a positive stop for aligning the closure and container at a predetermined angular orientation, and this prevents further relative rotation between the closure and the container.

The engagement of the protuberance within the recess serves as a means for preventing removal of the closure. Indeed, a person who would attempt to remove the closure would have to try to destroy or deform the closure, and this would provide evidence of tampering.

The novel positive orientation system permits application of a closure on a container by means of conventional, high-speed, automatic capping machines. The final angular (azimuthal) position of a closure on the container can be relatively precisely controlled with this novel system. The automated capping machine can initially apply the closure with a relatively low level of torque. After the recess and protuberance engage, the resistance torque increases greatly. Thus, the machine clutch mechanism can be easily set to disengage at this point and terminate the closure application process. The final orientation of the closure can be controlled by this system to within about 5% to 10% or less.

This novel positive orientation system can be easily provided in closures and containers molded from thermoplastic materials. The orientation system facilitates the design of the mold steel and the disposition of the mold locators. The thread orientation does not become critical, and control of the orientation can be achieved by maintaining dimensions of the closure skirt and container neck in areas that are usually not subject to variation by secondary operations such as trimming or reaming.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 4, on the second sheet of drawings with FIGS. 7–14, is a fragmentary, cross-sectional view taken generally along the plane 4—4 in FIG. 2;

FIG. 7 is a fragmentary, elevational view taken generally along the plane 7—7 in FIG. 3;

FIG. 8 is a fragmentary, cross-sectional view taken generally along the plane 8—8 in FIG. 7;

FIG. 9 is a top plan view of the container neck illustrated in FIG. 1;

FIG. 10 is a fragmentary, side elevational view of the container neck illustrated in FIG. 9;

FIG. 11 is a fragmentary, side elevational view of the container neck illustrated in FIG. 10 but with the container neck rotated 90°;

FIG. 12 is a greatly enlarged, fragmentary, side elevational view taken generally along the plane 12—12 in FIG. 9;

FIG. 13 is a fragmentary, cross-sectional view taken generally along the plane 13—13 in FIG. 12; and FIG. 14 is a fragmentary, cross-sectional view taken generally along the planes 14—14 in FIG. 5.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the closure and container which incorporate the features of this invention are described in a typical upright position, and terms such as upper, lower, horizontal, etc., are used with reference to this position. It will be understood, however, that the container and closure may be manufactured, stored, transported, used, and sold in an orientation other than that described.

Some of the figures illustrating the preferred embodiment of the container and closure assembly show conventional structural details and features that will be recognized by one skilled in the art. However, the detailed descriptions of such details and features are not necessary to an understanding of the invention, and accordingly, are not herein presented.

Figure 1:
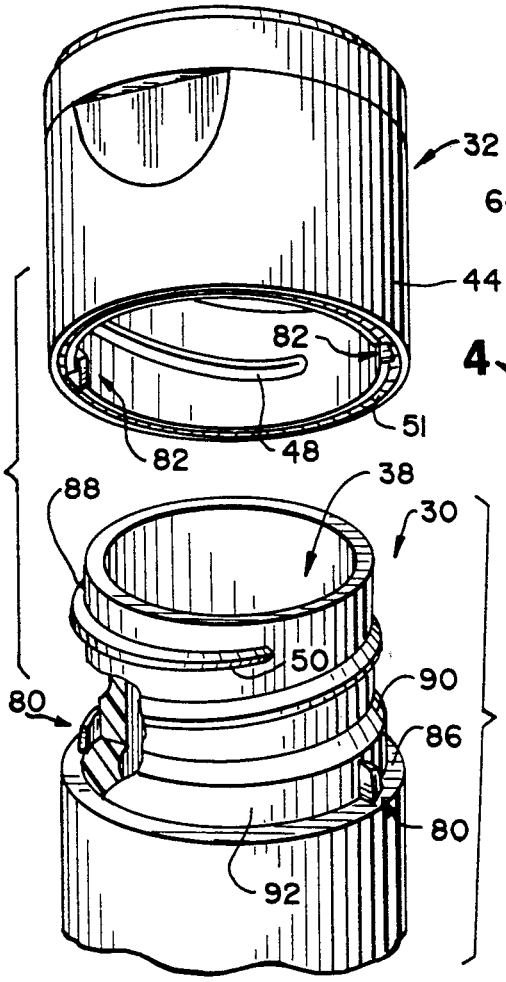
FIG. 1 is a fragmentary, exploded, perspective view of the closure and container assembly of the present invention.

The present invention provides a package in the form of a container and closure which incorporate a system for effecting a relative alignment or orientation with respect to external features on the container and closure. The system can be incorporated in a form that inhibits removal of the closure and provides evidence of tampering. With reference to FIG. 1, the system is illustrated in a container designated generally by the reference numeral 30 and in a closure designated generally by the reference numeral 32.

The closure 32 is adapted to be threadingly mounted on the container 30. The container 30 typically includes a body portion or receptacle portion (not visible in the figures) which may have any suitable special or conventional configuration and from which a neck 36 extends (as shown in FIG. 1) to receive the closure 32. The neck 36 defines an opening 38 through which the container contents can be dispensed.

As best illustrated in FIGS. 1 and 4, the closure 32 includes a housing, base, or body 40 for securement to the container neck 36. The closure body 40 includes a peripheral wall in the form of a generally cylindrical skirt 44. The skirt 44 includes, on its interior surface, a conventional thread 50 on the container neck 36 to secure the closure body 40 to the container 30.

The bottom of the skirt 44 defines a lower peripheral edge 51 (FIGS. 1 and 4). If the closure 32 is molded from thermoplastic material, then recesses or lugs 53 may be provided in the lower edge 51 to accommodate a suitable tool for unscrewing the closure from the mold. For ease of illustration, the unscrewing recesses or lugs 53 have been omitted from FIG. 1.

For a typical contemplated closure, sixteen lug recesses 53 may be provided around the bottom of the skirt 44 spaced 20° apart in two groups of eight. With reference to the cross-sectional view of FIG. 4, the depth of each lug recess is about 0.05 inch, the width of each lug recess is 0.033 inch, the outer side of each lug recess slants at an angle of 15° with respect to the vertical axis of the closure, and the inner side of each lug recess slants at an angle of 5° with respect to the vertical axis of the closure.

Each lug recess 53 has a length (extending in the direction perpendicular to the plane of FIG. 4), and the lengthwise profile (not illustrated) is defined by a generally vertical front wall with a depth of 0.05 inch, a top wall having a length of 0.033 inch, and a rear wall sloping to the lower peripheral edge 51 at a 150° angle as measured between the top wall and rear wall. The generally vertical front wall preferably has a 3° molding draft. The lug recesses 51 would not be required in a molded closure for which other mold release techniques would be employed. The lug recesses 51 form no part of the present invention.

Figure 2:
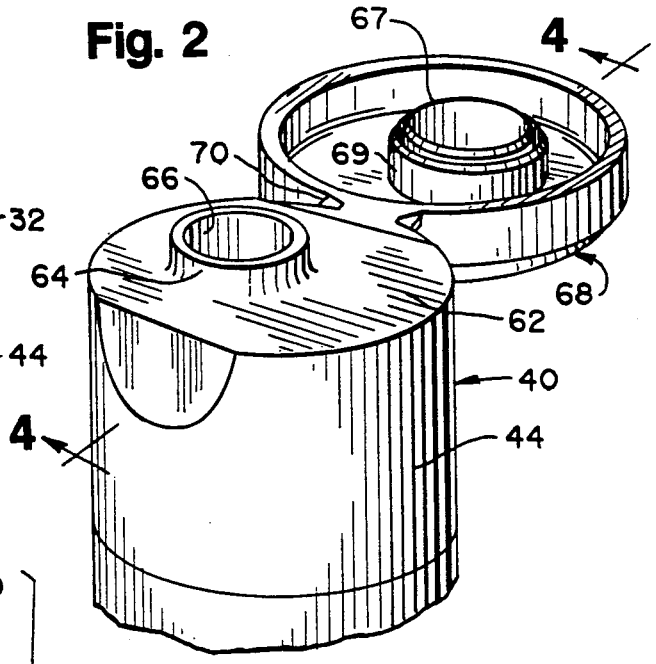
FIG. 2 is a fragmentary, perspective view of the container with the closure mounted thereon and with the closure lid in an opened position.
Figure 3:
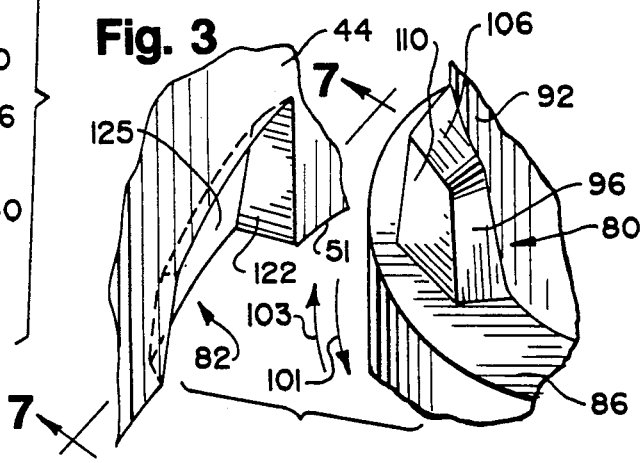
FIG. 3 is a greatly enlarged, fragmentary, exploded, perspective view of a protuberance on the container neck and of a mating recess in the closure skirt.

As best illustrated in FIGS. 2 and 4, the closure body includes a deck 62 from which depends an internal ring 56 (FIG. 4) that functions as a seal by protruding into the container opening 38 and against the container neck 36. The deck 62 also has an integral dispensing collar 64 defining a dispensing orifice 66.

A lid 68 is disposed on the closure body 40 and is adapted to be moved between an open position (FIGS. 2 and 4) for permitting the dispensing of the container contents and a closed position (FIG. 1) in which the dispensing orifice 66 is occluded.

The lid 68 may be completely removable from the closure body 40 or may be attached to it. In the illustrated preferred embodiment, the lid 68 is connected to the closure body by a suitable means, such as a snap-action hinge 70. Such a snap-action hinge 70 is formed integrally with the closure body 40 and lid 68. The illustrated snap-action hinge 70 is a conventional type described in the U.S. Pat. No. 4,403,712.

The lid 68 includes a downwardly projecting internal ring seal 67 for entering into and sealing the dispensing orifice 66. The lid 68 also includes an external ring 69 concentric with the internal ring seal 67 for engaging the outside of the dispensing orifice collar 64.

Preferably, the closure body, lid, and hinge are molded as a unitary structure from suitable thermoplastic materials compatible with the container and its contents. The details particular hinge structure, lid structure, and closure body deck structure form no part of the present invention.

The closure 32 may include other dispensing features instead of the collar 64 and dispensing orifice 66. For example, a special discharge structure, such as a spout, nozzle, spray device, or the like may be provided. Alternatively, a plurality of dispensing orifices, or other structures for discharging the container contents, may be provided in the closure 32. Depending upon the type of discharge structure incorporated, the full lid 68 may be entirely eliminated.

In any event, the present invention contemplates that the closure 32 includes some feature that is to be aligned in a particular orientation relative to the container 30. Such a feature may be a dispensing orifice. Such a feature could also be a particular thumb or finger grip area on the closure that is intended to be grasped in a particular orientation relative to the container.

If the closure includes a lid, such as the lid 68, it may be desired to orient the hinge part of the lid relative to one side of the container—especially if the container has a non-cylindrical shape. With a container of the type that has a non-cylindrical configuration, such as one with flat sides and/or special gripping regions, it may be desireable to insure that the lid, when opened, will have an orientation relative to the container that will not inhibit the pouring or dispensing of the contents from the container.

Finally, it may be desireable to orient the closure on the container for reasons unrelated to the closure dispensing structure and/or lid. For example, the closure may be molded with an unusual external configuration for aesthetic or trade dress reasons, and it may be desired to ensure that such a closure is mounted in a particular orientation relative to the container. Alternatively, the closure may include preprinted text or graphic materials for which a particular orientation relative to the container is desired.

According to the present invention, a novel positive orientation system is incorporated in the closure 32 and container neck 36 for establishing a predetermined orientation of the closure relative to the container when they are assembled together. In particular, protuberances 80 are provided on the container neck 36 for being received in recesses 82 defined in the closure skirt 44.

In the preferred embodiment, the recesses 82 are diametrically opposed. That is, the recesses 82 are spaced apart about 180°. The protuberances 80 on the container neck are similarly spaced apart about 180°. Depending upon the particular application and sizes of the components involved, the orientation system of the invention may include a greater or lesser number of protuberances and a greater or lesser number of recesses.

Each recess 82 is defined in the closure skirt 44 as opening to the inner surface of the skirt and as opening downwardly in the lower peripheral edge 51 of the skirt. Each recess 82 is disposed axially below the closure internal thread 48.

Each protuberance 80 is provided on the container neck 36 below the container external thread 50. The container neck 36 defines a first cylindrical surface 88 from which the thread 50 projects. An annular, frustoconical surface 90 extends from the first cylindrical surface 88 to a second cylindrical surface 92. The first and second cylindrical surfaces 88 and 92 are concentric, and the second cylindrical surface 92 has a diameter that is greater than the diameter of the first cylindrical surface 88. The major diameter of the container neck thread 50 is equal to the diameter of the second cylindrical surface 92. However, these diameters could, of course, be different, depending on the closure wall design and/or neck design.

The container neck 36 includes an annular shoulder 86 below the second cylindrical surface 92. The diameter of the second cylindrical surface 92 is smaller than the outer diameter of the annular shoulder 86.

Each protuberance 80 projects upwardly from the annular shoulder 86 and axially along the second cylindrical surface 92. However, the maximum height or axial extent of each protuberance 80 is less than the height of the second cylindrical surface 92.

Although each protuberance 80 projects radially outwardly from the second cylindrical surface 92, the maximum radial projection of each protuberance 80 beyond the second cylindrical surface 92 is less than the radial projection of the annular shoulder 86.

Each protuberance has pair of generally oppositely facing abutment surfaces—a leading abutment surface 96 and a trailing abutment surface 98 (FIGS. 5, 6, 9 and 12). The leading abutment surface 96 faces generally in a first direction of rotation in which the container neck thread 50 screws into the closure thread 48, and this direction is designated generally by the arrow 101 in FIGS. 5, 6, 9, and 12. The trailing abutment surface 98 faces generally in a second, opposite direction of rotation designated by the arrow 103.

Figure 6:
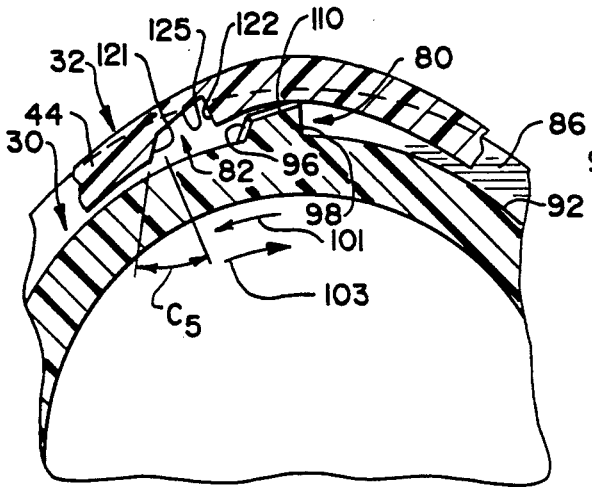
FIG. 6, on the first sheet of drawings with FIGS. 1–3 and 5, is a view similar to FIG. 5 but illustrating a moved position of the components prior to establishment of the final, closed position of the components.
Figure 5:
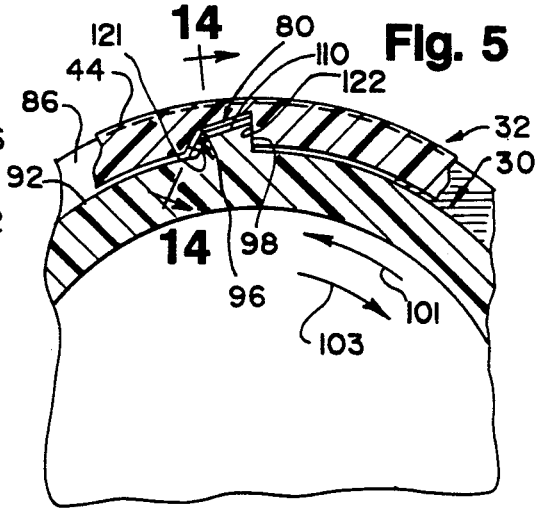
FIG. 5, on the first sheet of drawings with FIGS. 1–3 and 6, is a greatly enlarged, fragmentary, cross-sectional view taken generally along the plane 5—5 in FIG. 4.

As used in the specification and in some of the claims, the first and second directions of rotation, indicated by arrows 101 and 103, respectively, are defined with reference to the rotation of the container neck 36 as the container neck is viewed in a top plan view (e.g., FIGS. 5, 6, and 9). Of course, it will be appreciated relative rotation between the closure 32 and container neck 36 effects the screwing or unscrewing of the two components. Thus, if the closure 32 is rotated in the second direction of rotation indicated by arrow 103 while the container 30 is held stationary, then the screwing direction of the container neck thread 50 into the closure thread 48 can nevertheless still be characterized as the first direction of rotation designated by the arrow 101.

Each protuberance 80 preferably also includes at least a first cam surface 106 extending between the top of the leading abutment surface 96 and the top of the trailing abutment surface 98 (FIG. 12). Also, each protuberance 80 preferably includes a second cam surface 110 extending between the outer side edge of the leading abutment surface 96 and the outer side edge of the trailing abutment surface 98. The cam surface 106 is generally axially closer to the container opening 38 than is the cam surface 110.

In the preferred embodiment, each of the surfaces 96, 98, 106, and 110 is generally planar. The cam surface 110 depends from the cam surface 106 along an outer edge portion of the cam surface 106. As illustrated in FIG. 13, each cam surface 106 and 110 can be characterized as defining an acute angle relative to the container thread axis as measured on the plane of the trailing abutment surface 98. In particular, cam surface 106 is oriented relative to the container thread axis at an acute angle $B_1$, and the lower cam surface 110 is oriented relative to the container thread axis at a smaller angle $B_2$.

The trailing abutment surface 98 is preferably planar and is oriented generally vertically such that an extension of the plane defining the surface 98 would contain the container thread axis.

As best illustrated in FIG. 9, the leading abutment surface 96 of each protuberance extends increasingly radially outwardly with increasing angular displacement (i.e., circumferential distance around the neck) in the second, opposite direction of rotation indicated by arrow 103. For the preferred embodiment wherein the leading abutment surface 96 is generally planar, this may be characterized by the angle $A_1$ (FIG. 9) which is measured relative to a radius line of the container 30.

As illustrated in FIG. 12, the leading abutment surface 96 also extends increasingly axially closer to the container opening 38 with increasing angular displacement (i.e., circumferential distance around the neck) in the second direction of rotation designated by the arrow 103. For the illustrated preferred embodiment, where the leading abutment surface 96 is generally planar, this orientation can be characterized by the angle $A_2$ (FIG. 12) which is measured relative to the container neck thread axis.

In the preferred embodiment illustrated, the height of the upper edge of the cam surface 106 along the container neck surface 92 increases with increasing angular displacement (i.e., circumferential distance around the neck) in the second rotational direction as indicated by the arrow 103 can be seen in FIG. 12. This orientation, where the surface 106 is planar, can be characterized by the angle $A_3$ in FIG. 12.

Each of the protuberances 80 is adapted to be received in a recess 82. Each recess 82 is defined by a plurality of planar surfaces within the wall of the skirt 44. Specifically, each recess 82 is defined at opposite ends by spaced-apart engaging surfaces—a first engaging surface 121 and a second engaging surface 122. An angled, planar side surface 125 extends between the first engaging surface 121 and the second engaging surface 122 to define the side of the recess 82. A planar top surface 127 extends between the first engaging surface 121 and the second engaging surface 122 to define the top of the recess 82.

The side surface 125 is preferably oriented at an angle $C_1$ relative to the closure longitudinal axis or thread axis as illustrated in FIG. 8. This preferably conforms to the orientation of the protuberance cam surface 110 as shown in FIG. 14.

The top surface 127 is preferably oriented at an angle $C_2$ relative to thread axis of the closure 32 as illustrated in FIG. 7.

The orientations of the first and second engaging surfaces 121 and 122 conform generally, but not necessarily precisely, to the orientations of the container protuberance abutment surfaces 96 and 98, respectively. In particular, the second engaging surface 122 is approximately radially oriented but, for mold release purposes, may have a small draft angle $C_3$ (e.g., about 5° as best shown in FIG. 7).

On the other hand, the first engaging surface 121 may be oriented at a substantial angle $C_4$ relative to the closure thread axis. The surface 121 would thus extend axially further from the lower peripheral edge 51 with increasing angular displacement (i.e., circumferential distance) in the second direction of rotation (indicated by arrow 103 in FIG. 7).

If desired, the first engaging surface 121 may also be slanted with respect to the radial direction as can be seen in FIG. 6. That is, the first engaging surface 121 could extend increasingly radially outwardly with increasing angular displacement in the second rotation direction 103 as viewed in FIG. 6. This defines an azimuthal angle $C_5$ which may be, for example, about 5° relative to a radius line so as to generally correspond with the angle $A_1$ of the confronting surface 96 on the protuberance 80. On the other hand, the closure 32 may be simplified, if desired, by omitting the azimuthal angle of the first engaging surface 121 and making the surface 121 generally parallel to a radius line of the closure (i.e., $C_5=0$).

In one presently contemplated design that incorporates the features of the illustrated preferred embodiment, the thickness of the closure skirt 44 at the lower edge 51 is about 0.058 inch. For each recess 82, the angle $C_1$ is 15°, the angle $C_2$ is 15°, the angle $C_3$ is 5°, and the angle $C_4$ is 15°. For each protuberance 80, the angle $B_1$ is 45°, the angle $B_2$ is 15°, the angle $A_1$ is 5°, angle $A_2$ is 15°, and the angle $A_3$ is 110°. Each protuberance 80 has a maximum thickness (in the radial direction along the base of the trailing abutment surface 98) of about 0.094 inch. The radial thickness of the base of the protuberance 80 at the corner defined by the leading abutment surface 96 and the lower cam surface 110 is about 0.055 inch. The maximum height of each protuberance 80 (at the top of the trailing abutment surface 98 adjacent the container neck surface 92) is about 0.125 inch. The height of each protuberance 80 at the top of the leading abutment surface 96 adjacent the container neck surface 92 is about 0.09 inch.

The novel design of the mating protuberance and recess structure accommodates the threading together of the container 30 and closure 32 to a predetermined orientation. FIG. 6 illustrates the engagement of the closure 32 with the container 30 as relative threading movement between the two parts is effected prior to the protuberances 80 being received in the recesses 82.

As more threaded engagement is established between the two parts, the lower peripheral edge 51 of the closure skirt 44 begins to engage the upper cam surface 106 of each protuberance 80. The skirt 44 is resilient and can deform outwardly to accommodate the overlapping axial movement between each protuberance 80 and the skirt 44. In a contemplated embodiment, the engagement between the bottom of the skirt 44 and the upper end each protuberance 80 would begin about one-half turn prior to the final, desired relative positions of the closure and container.

As more relative rotation is effected, the skirt 44 is deformed outwardly by each protuberance 80 until each protuberance 80 is received in a recess 82 as illustrated in FIG. 5. At this point, the resiliency of the skirt material is sufficient to restore the skirt to its original cylindrical configuration. The second engaging surface 122 of the recess snaps inwardly adjacent the trailing abutment surface of the protuberance 80. The first engaging surface 121 of the recess snaps inwardly adjacent the leading abutment surface 96 on the protuberance 80. Further relative rotation in either direction is prevented. Thus, the relative orientations of the closure 32 and container 30 are established.

Further, removal of the closure 32 from the container 30 by a normal unscrewing process is prevented or inhibited. The closure 32 would have to be subjected to extreme, and permanent, deformation in order to disengage the closure skirt 44 from the container protuberance 80. It would be difficult or impossible to do that without a tool and, in any case, the permanent deformation would provide evidence of tampering.

In the illustrated preferred embodiment the closure skirt 44 has sufficient resiliency to temporarily deform as necessary to accommodate the seating of the protuberances 80 in the recesses 82. It will be appreciated, however, that with an appropriate design, the skirt 44 may be relatively rigid, and the neck of the container 30 may be sufficiently resilient to provide the necessary temporary deformation to permit the desired engagement of the parts. Further, both parts could be somewhat resilient so that the parts could each be temporarily deformed as necessary to accommodate the final engagement.

The novel positive orientation system of the present invention can be provided on a closure and container neck with relatively little modification of a conventional finish which will not interfere with the conventional threads. The height o each protuberance 80 and of each receiving recess 82 may be determined by the particular pitch of the thread that is used and by the number of co-acting protuberances and recesses that are provided.

The container neck 36 and the container closure 32 are made (e.g., typically molded from thermoplastic materials) so that they can be threaded together to the proper orientation. To this end, the specific shapes, as well as the overall height and width dimensions, must be accommodated. FIG. 10 illustrates the outermost thread diameter $T_N$ for the container neck thread 50 and illustrates the height $H_N$ of the container neck above the shoulder 86. Analogously, in FIG. 4, the diameter of the closure 32 at the base or root of the thread 48 is designated by the reference letter $T_C$, and the height of the inside cavity of the closure (from the lower edge 51 to the lower surface of the deck 62) is designated by the reference letter $H_C$. These dimensions, especially the container neck height $H_N$, are subject to variation owing to secondary operations, such as trimming or reaming, which may be performed after molding. Thus, the use of such dimensions for locating an orientation structure on the container neck relative to an orientation structure on the closure could lead to misalignment.

Advantageously, the novel protuberances 80 and recesses 82 of the present invention permit the parts to be made (e.g., molded) so that proper alignment will occur in the assembled, closed condition even if the dimensions $H_C$ and $H_N$ are not precisely controlled during molding or if they are otherwise altered after molding.

In particular, for the container neck, as illustrated in FIG. 10, a controlled vertical dimension $C_N$ is identified as extending axially at the outermost thread diameter along the plane defined by the protuberance surface 98, and the dimension is the distance between the shoulder 86 and the bottom face of the thread 50. By measuring the dimension $C_N$ along the plane defined by the protuberance surface 98, the azimuthal or circumferential location is clearly defined with respect to the distance between the face of the thread form 50 and the shoulder 86. This area on the container neck is conventionally formed in a neck ring device and is not subject to variation due to secondary operations such as trimming or reaming. It will be understood, of course, that the thread form 50 has a uniform, or constant, helix angle.

A corresponding control dimension, designated by reference letter $C_C$ in FIG. 4, is employed with the closure 32. In particular, the dimension $C_C$ is measured between the bottom face 51 of the closure skirt and the bottom of the thread 48 at the thread root or base where the thread 48 merges with the inner diameter $T_C$ of the closure. The dimension $C_C$ is selected with respect to a particular circumferential or azimuthal location on the closure interior, and that circumferential location is located on the vertical plane defined by the closure longitudinal axis and a selected point at one of the recesses 82, such as, for example, the lower edge of the recess wall 122 (FIGS. 4 and 8).

The tolerance of the closure/container orientation can be controlled by the fit of the protuberances 80 within the recesses 82. The orientations of the recesses 82 are determined by the mold steel design and by the disposition of the mold locators.

The thread orientation is not particularly critical, although it preferably is controlled within acceptable conventional practices to permit proper application of the closure to the container. Accordingly, a gage may be employed to align the rotating mold core with the sleeve projection to achieve proper core alignment at mold set up as well as to monitor tolerances during production, if necessary.

With the positive orientation system of the present invention, the final applied orientation of the closure on the container can be controlled to within plus or minus 5° to 10° of angular displacement, or less, depending upon parts tolerances.

It will be readily apparent from the foregoing detailed description of the invention and from the illustrations thereof that numerous variations and modifications may be effected without departing from the true spirit and scope of the novel concepts or principles of this invention.

What is claimed is:

1. A container and a non-removable closure assembly comprising:

a container having a neck defining an opening to the container interior, an external screw thread, and a protuberance;

said protuberance defining a) a leading abutment surface facing generally in a first direction of rotation in which said container neck thread screws into said closure thread, said leading abutment surface extending increasingly radially outwardly and increasingly axially closer to said opening with increasing circumferential distance around said neck in a second direction opposite to said first direction, b) a trailing abutment surface facing generally in the second direction of rotation, and c) a first cam surface extending between said leading and trailing abutment surfaces, said first cam surface extending increasingly radially outwardly and increasingly axially closer to said opening with increasing circumferential distance around said neck in said second direction;

d) a second cam surface extending from said first cam surface in a direction away from said opening, said second cam surface extending between said leading and trailing abutment surfaces, said cam surface extending increasingly radially outwardly and increasingly axially closer to said opening with increasing circumferential distance around said neck in said second direction;

a closure for being applied to said container neck and having a skirt defining an interior surface and a lower peripheral edge for engaging said first cam surface, said skirt defining an internal screw thread on said interior surface for engaging said external screw thread, said skirt further defining a recess in said interior surface and opening to said lower peripheral edge for receiving said container neck protuberance, said recess being defined on one end by a first engaging surface facing generally in a direction for engaging said leading abutment surface, said recess being defined on another end by a second engaging surface facing generally in a direction for engaging said trailing abutment surface, said recess being defined radially between said first and second engaging surfaces by a side surface, said side surface and said first engaging surface each extending increasingly radially outwardly and increasingly axially further from said lower peripheral edge with increasing circumferential distance around said closure in the direction toward said second engaging surface; and at least one of said skirt and neck being sufficiently resilient to deform as relative threading engagement is effected between said closure and said container neck to accommodate the relative movement of said protuberance and skirt interior surface until said protuberance is received in said recess, said skirt being sufficiently stiff to prevent relative rotation between said closure and container in either direction.

2. The assembly in accordance with claim 1 in which said trailing abutment surface is generally planar and lies in a plane containing the axis of said container screw thread.

3. The assembly in accordance with claim 1 in which said leading abutment surface is generally planar.

4. The assembly in accordance with claim 1 in which said container defines an annular shoulder having an outer diameter below said container neck thread; and said protuberance projects from said shoulder toward said container opening.

5. The assembly in accordance with claim 4 in which said container neck defines a first cylindrical surface extending from said opening for a first axial distance;

said container neck defines a second cylindrical surface axially located between said shoulder and said first cylindrical surface;

said first and second cylindrical surfaces are concentric;

said second cylindrical surface has a diameter that is greater than the diameter of said first cylindrical surface and that is smaller than the outer diameter of said annular shoulder;

said container neck thread projects from said first cylindrical surface;

said container neck thread has a major diameter equal to the diameter of said second cylindrical surface; and said protuberance extends axially along a portion of said second cylindrical surface.

6. The assembly in accordance with claim 5 in which said protuberance projects radially outwardly from said second cylindrical surface; and the maximum radial projection of said protuberance beyond said second cylindrical surface is less, than the radial projection of said annular shoulder as defined by its outer diameter.

7. The assembly in accordance with claim 5 said first and second cylindrical surfaces are axially spaced apart and connected by a frustoconical surface.

8. The assembly in accordance with claim 1 in which said closure first engaging surface is generally planar.

9. The assembly in accordance with claim 1 in which said closure second engaging surface is generally planar.

10. The assembly in accordance with claim 9 in which said second engaging surface lies on a plane oriented at an angle of about 5° relative to the axis of said closure thread.

11. The assembly in accordance with claim 1 in which said closure includes a planar top surface that is oriented perpendicular to the axis of said closure thread and that extends between the first and second engaging surfaces to define the top of said recess.

12. The assembly in accordance with claim 1 in which said container includes two of said protuberances circumferentially spaced apart about 180°; and said closure includes two of said recesses circumferentially spaced apart about 180°.

13. A container and a non-removable closure assembly comprising:

a container having a neck defining an opening to the container interior and an external screw thread;

a closure for being applied to said container neck and having a skirt defining an internal screw thread for engaging the external screw thread;

one of said container of closure having a protuberance with generally oppositely facing abutment surfaces and at least one cam surface extending between said abutment surfaces, said one cam surface being oriented at an oblique angle to the axis of the container thread;

a recess defined in the other one of said container and closure for receiving said protuberance, said recess being defined at opposite ends by spaced-apart engaging surfaces and being defined on one side between said spaced-apart engaging surfaces by a side surface; and at least one of said skirt and neck being sufficiently resilient to deform as relative threading engagement is effected between said closure and container neck to accommodate the relative movement of said container neck and closure so that said skirt rides against said one cam surface and at least one of said skirt and neck deforms until said protuberance is received in said recess, said one of said skirt and neck being sufficiently stiff to prevent relative rotation between said closure and container after said protuberance is received in said recess for preventing removal of said closure.

14. The assembly in accordance with claim 13 in which said protuberance projects from said container neck and in which said recess is defined in said closure skirt.

15. The assembly in accordance with claim 14 in which said closure skirt has a lower peripheral edge;

said recess opens to said lower peripheral edge; and said closure internal screw thread terminates at a location axially displaced from said lower peripheral edge, said location being further from said lower peripheral edge than is any portion of said recess.

16. The assembly in accordance with claim 13 in which said protuberance is defined on said container neck;

one of said oppositely facing abutment surfaces is generally planar and lies in a plane containing the axis of said container screw thread; and the other of said abutment surfaces extends increasingly radially outwardly and increasingly axially closer to said container neck opening with increasing circumferential distance around said container neck in a selected circumferential direction.

* * * * *